US007814584B2

(12) United States Patent
Robles et al.

(10) Patent No.: US 7,814,584 B2
(45) Date of Patent: Oct. 19, 2010

(54) BATHING APPARATUS

(76) Inventors: Kenny Robles, 42044 Corte Inquitto, Murrieta, CA (US) 92562; Patty Robles, 42044 Corte Inquitto, Murrieta, CA (US) 92562

( * ) Notice: Subject to any disclaimer, the term of this patent is extended or adjusted under 35 U.S.C. 154(b) by 1129 days.

(21) Appl. No.: 11/379,764

(22) Filed: Apr. 21, 2006

(65) Prior Publication Data

US 2007/0245484 A1 Oct. 25, 2007

(51) Int. Cl.
*A61K 33/02* (2006.01)

(52) U.S. Cl. ..... 4/545; 4/572.1

(58) Field of Classification Search ..... 4/572.1, 4/545, 574.1, 659, 622, 626, 616, 516; 119/603, 119/673; 219/436, 385
See application file for complete search history.

(56) References Cited

U.S. PATENT DOCUMENTS

| | | | | |
|---|---|---|---|---|
| 904,677 | A | 11/1908 | Braun | |
| 2,781,522 | A | 2/1957 | Phillips et al. | |
| 2,854,671 | A | 10/1958 | Setecka | |
| 4,546,505 | A | 10/1985 | Wakenshaw | |
| 5,276,926 | A | 1/1994 | Lopez | |
| 5,926,866 | A | 7/1999 | Chao | |
| 6,108,829 | A | 8/2000 | Wadsworth | |
| 6,243,890 | B1 * | 6/2001 | Yang | 4/572.1 |
| 6,543,068 | B1 | 4/2003 | Penninger | |
| 6,802,088 | B1 | 10/2004 | Gruner | |
| 7,032,259 | B1 * | 4/2006 | Kilion | 4/572.1 |
| 2004/0140304 | A1 * | 7/2004 | Leyendecker | 219/386 |
| 2007/0033727 | A1 * | 2/2007 | Liu | 4/572.1 |

* cited by examiner

*Primary Examiner*—Gregory L Huson
*Assistant Examiner*—Janie Christiansen
(74) *Attorney, Agent, or Firm*—QuickPatents, Inc.; Kevin Prince

(57) ABSTRACT

Disclosed is a bathing apparatus for a child that comprises a tub and a cradle. The tub is nestable with the cradle and includes a bottom wall and at least one side wall, each wall having an inside and an outside surface. The bottom wall includes a heat conductive means for conducting heat from the outside surface to the inside surface thereof. The cradle comprises a tub receiving portion and a base. The tub receiving portion is adapted for nestable engagement with the tub and further includes a heat generating means. When the tub is nested with the cradle, the heat generating means makes physical contact with the heat conductive means of the tub so as to allow heat transmission thereto. An electric switch is located electrically between the heating element and a power source. The electric switch is preferably a thermostat for deactivating the heat generating means when the water in the tub reaches a selected temperature. A water spraying means is preferably included that may be actuated to circulate water from the tub, through the pump, through the spray nozzle, and back into the tub.

10 Claims, 2 Drawing Sheets

BATHING APPARATUS

CROSS-REFERENCE TO RELATED APPLICATIONS

Not applicable.

STATEMENT REGARDING FEDERALLY SPONSORED RESEARCH AND DEVELOPMENT

Not applicable.

FIELD OF THE INVENTION

This invention relates to bathing devices, and more particularly to a heated bathing apparatus for use with a child.

DISCUSSION OF RELATED ART

When bathing a child or infant, it is important not to start with water that is too hot. Most adults fill a child's bathing tub with water that would be considered lukewarm or tepid at best, just to be sure that they do not inadvertently burn or overheat a young child while bathing. However, such tepid bathwater tends to quickly become cool or downright cold, particularly with a tub having little or no insulation.

U.S. Pat. No. 6,108,829 to Wadsworth on Aug. 29, 2000, teaches a portable hot tub that includes a remotely-located heating unit attached to the tub with hoses. Such a device may be well-suited for outdoor use, but it is not suitable for use as a bathing tub for infants who should be bathed indoors in a warm environment.

U.S. Pat. No. 5,276,926 to Lopez on Jan. 11, 1994, discloses a baby bath having a movable seat. Such a device may be positioned adjacent to a hot water source, such as a standard bath tub or a sink, but this device does little to maintain the temperature of the water. After a short period of time any tepid or warm water in such a device becomes too cool for the infant to remain therein. Such a devices also features a water spraying nozzle. However, such a nozzle receives water from a water source, and not from within the tub itself, and therefore has the effect of increasing the amount of water in the tub during use. Moreover, relying on water from a water source such as a faucet has the drawback that water temperature at the faucet may change without the person who is bathing the child being aware of such. This can lead to scalding or shocking the infant with either intensely hot or cold water, due to changing water pressure conditions at the faucet caused by such events as flushing a toilet somewhere else in the house.

U.S. Pat. No. 5,926,866 to Chao on Jul. 27, 1999, teaches a movable bathtub for a baby. While it may be convenient to roll such a tub close to a hot water source, such as a conventional bathtub, such water again can quickly cool unsuitably quickly. Further, such a device is rather bulky and cannot easily be placed on a countertop where a standing parent would find it most comfortable to bath the child. Indeed, due to the rollers it would be dangerous to place a child in such a device while the device is on a countertop, as movement of the child within the tub could cause such a device to roll off of the countertop.

U.S. Pat. No. 904,677 to Braun on Nov. 24, 1908, discloses a device that provides for passing therapeutic electric current through water in a bathtub. While this device does provide for an electrical source at a bathtub, clearly such a device is unsuitable for use with routine bathing of a child. Further, electrical current through water by itself is an inefficient water heating method, and therefore such a device is not well suited for heating water in a bathtub.

U.S. Pat. No. 5,966,752 to Abugideiri on Oct. 19, 1999, illustrates a baby bathtub and shower device. As with the -926 device, however, water spraying on the child is received by the spray nozzles directly from a hot water faucet, and as such has inherent dangers associated with sudden water temperature changes at the faucet.

Clearly, then, there is a need for a baby bathing apparatus that allows relatively easy initial filling of the tub from a convenient hot water source, such as a bathtub or sink faucet. Such a needed device would further provide a means of keeping such a tub stable while on a countertop surface, for example, and would additionally include means for maintaining the temperature of the water within the tub. The needed device would further include a spray nozzle means that would not overfill the tub during use, and would not expose the child to risks associated with sudden pressure and temperature changes in the household water supply lines. The needed device would further be easy to drain, clean, and maintain. The present invention accomplishes these objectives.

SUMMARY OF THE INVENTION

The present device is a bathing apparatus for a child that comprises a tub and a cradle. The tub is nestable with the cradle and comprises a bottom wall attached to at least one side wall. Each wall includes an inside surface and an outside surface. The tub is preferably molded from a plastic material that is a relatively good heat and electrical insulator. The bottom wall includes a heat conductive means for conducting heat from the outside surface to the inside surface thereof. Preferably the heat conduction means further includes heat conductive arms that traverse through the bottom wall and the at least one side wall. A plurality of water ports are formed on the inside surface of the bottom wall and the at least one side wall such that heat may be conducted from the heat conductive means to the plurality of water ports. As such, water in the tub may enter the water ports and contact the conductive arms to be heated, but children's fingers and the like cannot.

The cradle comprises a tub receiving portion and a base. The tub receiving portion is adapted for nestable engagement with the tub and further includes a heat generating means. When the tub is nested with the cradle, the heat generating means makes physical contact with the heat conductive means of the tub so as to allow heat transmission thereto. The base preferable includes at least one footing means for frictionally supporting the apparatus on a level surface.

An electric switch is located between the heating element and a power source. The electric switch is preferably a thermostat for deactivating the heat generating means when the water in the tub reaches a selected temperature.

A water spraying means is preferably included that includes a spray nozzle connected to a hand-actuated valve, a water hose, and a water pump. The water pump is electrically connected to the power source, and the water pump is in fluid communication with the inside of the tub. As such, with the tub nested with the cradle, the water pump may be actuated to circulate water from the tub, through the pump, through the spray nozzle, and back into the tub.

The present device is a baby bathing apparatus that allows relatively easy initial filling of the tub from a convenient hot water source, such as a bathtub or sink faucet. Further, the present invention provides a means of keeping such a tub stable while on a countertop surface, for example, and additionally includes means for maintaining the temperature of the water within the tub. Moreover, the present device includes a spray nozzle means that cannot overfill the tub during use, as it re-circulates water within the tub, and does not expose the child to risks associated with sudden pressure and temperature changes in the household water supply lines. The present invention is easy to drain, clean, and maintain. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
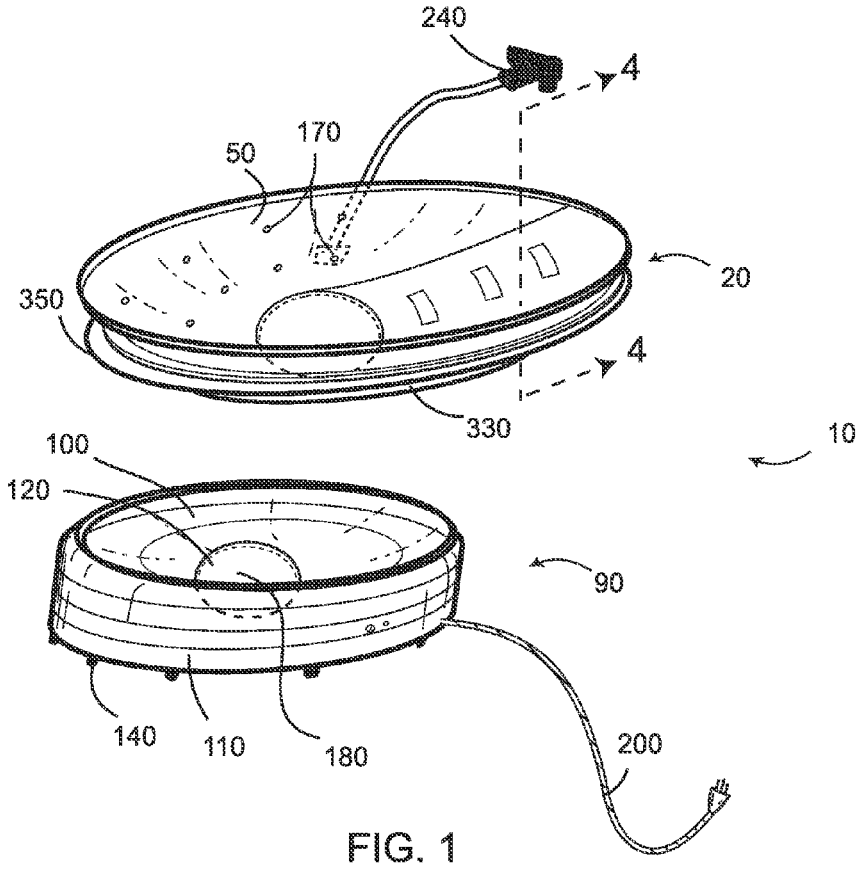
FIG. 1 is an exploded perspective view of the invention, illustrating a cradle and a nestable tub of the invention.
Figure 2:
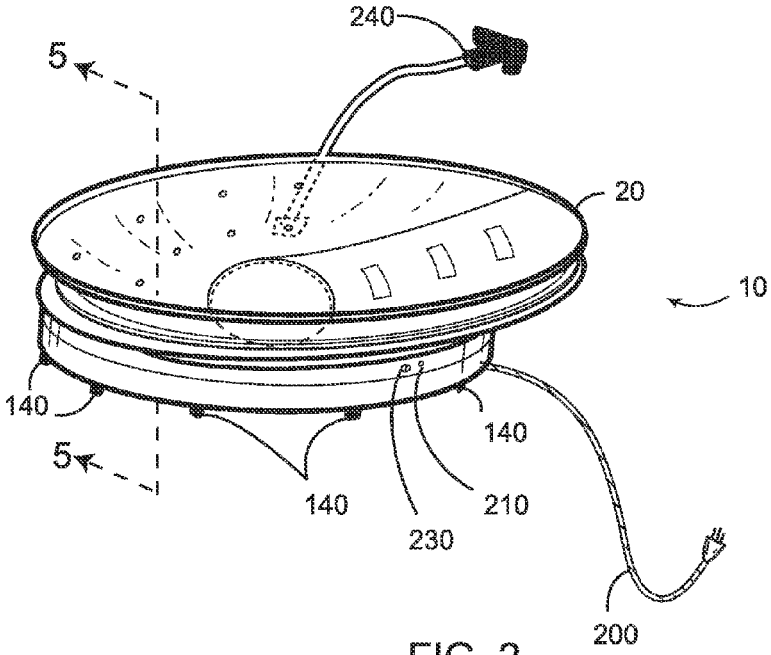
FIG. 2 is a perspective view of the invention, illustrated the tub nested with the cradle.
Figure 4:
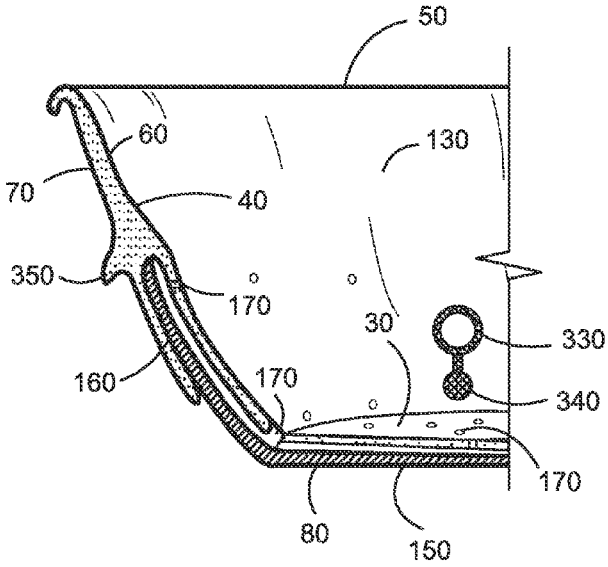
FIG. 4 is a partial cross-sectional view of the invention, taken along lines 4-4 of FIG. 2.

FIGS. 1 and 2 illustrate a bathing apparatus 10, typically for a small pet or child (not shown). The bathing apparatus 10 comprises a tub 20 and a cradle 90. The tub 20 is nestable with the cradle 90 such that when nested, as shown in FIG. 2, the cradle 90 fully supports the tub 20, and the tub 20 does not rock or otherwise move with respect to the cradle 90. The tub 20 comprises a bottom wall 30 attached to at least one side wall 40. The tub 20 forms a water-tight enclosure 50 (FIG. 4). Each wall 30,40 includes an inside surface 60 and an outside surface 70. The tub 20 is preferably molded from a plastic material that is a relatively good heat and electrical insulator. The tub 20 may include cushions or other comfort-improving features on the inside surface 60 thereof Preferably the outside surface 70 includes a lip 350 projecting outwardly and downwardly such that water 130 running down the outside surface 70 drips off of the lip 350 and does not travel down to the bottom wall 30 or into the cradle 90. Further, a drain aperture 330 is included in the at least one side wall 40 or the bottom wall 30. A cooperating drain plug 340 is included to allow selective draining of the water 130 in the tub 20, the drain plug 340 when inserted into the aperture 330 completely occludes the aperture 330 and remains therein by friction and water pressure until manually removed. In one embodiment of the invention, the aperture 330 of the tub 20 aligns with a water conducting chute of the cradle 90 (not shown) so that water may be drained from the tub 20 through the chute and into a sink drain, or the like. Clearly such a water conducting chute could be a conduit or ramp or any other such structure that is formed to conduct water away from the cradle 90.

The bottom wall 30 includes a heat conduction means 80, such as a heat conductive plate 150, for conducting heat from the outside surface 70 to the inside surface 60 thereof. Preferably the heat conduction means 80 further includes heat conductive arms 160 connected to the heat conductive plate 150 and traversing through the bottom wall 30 and the at least one side wall 40. Preferably the heat conductive arms 160 and the heat conductive plate 150 are made from an efficient metallic heat conductor, or any other suitably efficient and durable heat conductive material. Clearly the heat conductive plate 150 and the heat conductive arms 160 may be stamped from a single sheet of suitable metal material, or the like.

Further, a plurality of water ports 170 are formed on the inside surface 60 of the bottom wall 30 and the at least one side wall 40 such that heat may be conducted from the heat conductive plate 150 through the heat conductive arms 160 to the plurality of water ports 170 (FIG. 4). As such, water 130 in the tub 20 may enter the water ports 170 and contact the conductive arms 160 to be heated. Preferably each conductive arm 160 includes at least one associated lower water port 170 and at least one associated upper water port 170, such that colder water 130 naturally enters the lower water port 170, rises up towards the upper water port 170 as it is heated, and then exits back into the tub water tight enclosure 50. Each water port 170 is sized so as to prevent fingers or other portions of a child (not shown) sitting in the tub 20 from directly contacting the heat conductive arms 160 or the heat conductive plate 150.

Figure 5:
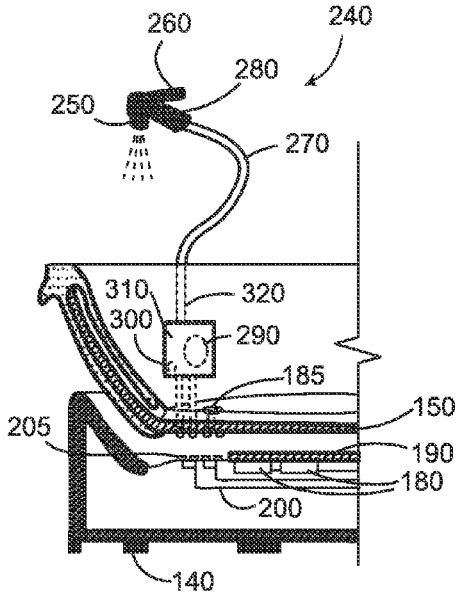
FIG. 5 is a partial cross-sectional view of the invention, illustrating the tub nearly nested with the cradle of the invention.

The cradle 90 comprises a tub receiving portion 100 and a base 1 10. The tub receiving portion 100 is adapted for nestable engagement with the tub 20 and further includes a heat generating means 120, such as at least one electric heating element 180 attached either to or proximate to a hot plate 190 (FIG. 5). When the tub 20 is nested with the cradle 90, the hot plate makes physical contact with the heat conductive plate 150 of the tub 20 so as to allow heat transmission thereto. The base 110 preferable includes at least one footing means 140 (FIGS. 1, 2 and 5) for frictionally supporting the apparatus on a level surface (not shown).

In an alternate embodiment of the invention, the heat conductive plate 150 of the tub 20 is formed in either the at least one side wall 40, or both the bottom wall 30 and the at least one side wall 40 (not shown). In such an alternate embodiment, heat may be transferred to the heat conductive arms 160 more directly from multiple hot plates 190.

Figure 3:
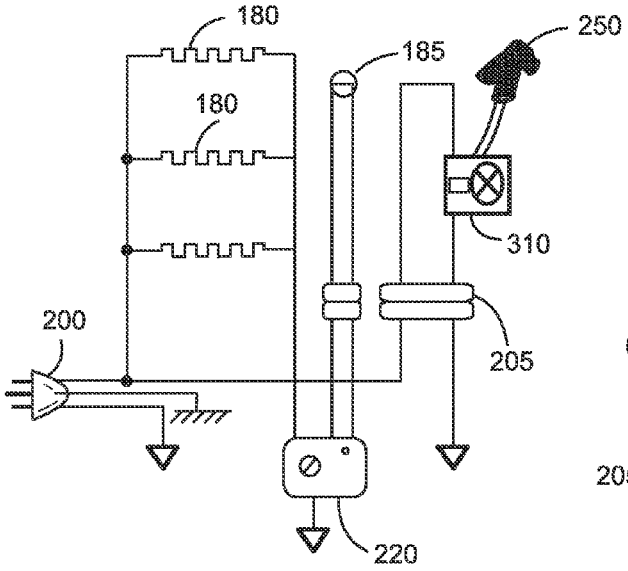
FIG. 3 is a schematic diagram of electrical components of the invention.

An electric switch 210 is located between the heating element 180 and a power source 210 (FIG. 3). The power source 210 is preferably an AC power line, but can also be a battery power source (not shown), the battery being located within the cradle 90 and optionally being a rechargeable battery. Alternately, the power source 210 may be a low-voltage DC power source, such as from a 24V AC adapter, or the like. The electric switch 210 is optionally a thermostat 220 for deactivating the at least one heating element 180 when the water 130 in the tub 20 reaches a selected temperature. In such an embodiment, a temperature sensing means 185, such as a thermister, is positioned in close thermal communication with the water 130 in the tub 20 and electrically connected to the thermostat 220 when the tub 20 is nested with the cradle 90 (FIG. 5). The thermostat 220 preferably includes a manually actuable temperature selector 230 positioned through the base 110 such that the temperature selector 230 may be adjusted manually while the tub 20 is nested with the cradle 90 (FIG. 2).

A water spraying means 240 is optionally included that includes a spray nozzle 250 connected to a hand-actuated valve 260. A water conducting hose 270 is included, one end 280 of which is in fluid communication with the valve 260 at attached thereto. A water pump 290 is included in fluid communication at a low-pressure side 300 thereof with the water 130 in the tub 20, preferably at one of the water ports 170. A high-pressure side 310 of the water pump 290 is in fluid communication with an opposite end 320 of the hose 270. Further, the water pump 290 is connected to the power source 200 when the tub 20 is nested with the cradle 90 via a conductor means 205 (FIG. 3), such as spring-loaded conductor pins and a conductor plate, for example. As such, upon actuation of the valve 260 the water pump 290 is actuated to pump water 130 from the tub 20, through the water pump 290, through the hose 270, and out of the spray nozzle 250. As such, with water 130 at least partially filling the tub 20 and with the tub 20 nested with the cradle 90, the heat generating means 120 produces heat that is conducted through the heat conduction means 80 of the tub 20 for warming the water 130 to the selected temperature.

The temperature sensing means 185 and the water pump 290 are each fixed to the tub 20, but electrically connected to the cradle 90 when the tub 20 is nested with the cradle 90. Such electrical connections may be accomplished in any number of ways known in the art, but preferably spring-loaded electrical connector pins are positioned on the outside surface 70 of the tub 20 in such a way that they each contact a single corresponding electrode plate fixed to the tub receiving means 100 of the cradle 90. The power source 200 may include a ground-fault interrupt circuit breaker (not shown) that trips if a short is detected between the power source 200 and the water 130 or ground for safety.

In use, preferably heated water 130 is introduced into the tub 20 at a water source (not shown). When a suitable amount of water 130 is contained in the tub 20, the tub 20 may be brought to the cradle 90 and nested therewith. The power source 200 is then applied, such as by plugging a cord into a wall power receptacle, and the thermostat 220 is adjusted to a desired temperature. A child or pet may then be introduced into the tub 20 for bathing, such bathing being facilitated by the water spraying means 240. During even an extended bath, the water 130 is heated to maintain the desired temperature. Water 130 splashed outside of the tub 20 that contacts the outside surface 70 runs down to the lip 350, where it then drips onto the surface upon which the cradle 90 is positioned. The lip 350 prevents water 130 from continuing down the surface 70 to contact any of the electrical elements of the apparatus 10. Upon completion of the bath, the tub 20 may be removed from the cradle 90 and positioned over a sink, bathtub, or other receptacle with a drain, and the drain plug 340 may be pulled from the drain aperture 330 to drain the water 130 in the tub 20.

While a particular form of the invention has been illustrated and described, it will be apparent that various modifications can be made without departing from the spirit and scope of the invention. For example, the exact configuration of the water ports 170 and the heat conductive arms 160 may be altered to assume any variety of patterns. Likewise, the specific shape of the tub 20 may be changed to include various additional non-skid features, soap dispensers, shampoo container holders, and the like. Accordingly, it is not intended that the invention be limited, except as by the appended claims.

What is claimed is:

1. A bathing apparatus for a child comprising:

a tub, the tub comprising a bottom wall attached to at least one side wall, the tub forming a water-tight enclosure, each wall including an inside surface and an outside surface, at least one of the walls including a heat conduction means for conducting heat from the outside surface to the inside surface thereof; and a cradle comprising a tub receiving portion and a base, the tub receiving portion adapted for nestable engagement with the tub and further including a heat generating means, the heat conduction means of the tub comprising a heat conductive plate formed on the outside surface of the bottom wall, heat conductive arms connected to the heat conductive plate and traversing through the bottom wall and side walls, and water ports formed on the inside surface of the bottom wall and side walls;

whereby with the tub at least partially filled with water and with the tub nested with the cradle, the heat generating means produces heat that is conducted through the heat conduction means of the tub for warming the water, such that heat may be conducted from the heat conductive plate through the heat conductive arms to the heat water ports, water thereby being able to be heated by entering the water ports and contacting the heat conductive arms.

2. The bathing apparatus of claim 1 wherein the base of the cradle further includes a footing means for frictionally supporting the apparatus on a level surface.

3. The bathing apparatus of claim 1 wherein the water ports are sized so as to prevent fingers or other portions of the child sitting in the tub from directly contacting the heat conductive arms or heat conductive plate.

4. The bathing apparatus of claim 1 wherein the heat generating means is an electric heating element attached to a hot plate formed in the tub receiving portion of the cradle, the hot plate in physical contact with the heat conductive means of the tub when the tub is nested with the cradle, the heating element electrically connected to a power source.

5. The bathing apparatus of claim 4 further including an electric switch electrically located between the heating element and the power source.

6. The bathing apparatus of claim 5 wherein the electric switch is attached through the base so as to be manually actuable.

7. The bathing apparatus of claim 6 wherein the electric switch is attached to a thermostat for deactivating the heating element when water in the tub reaches a selected temperature, the thermostat including a manually actuable temperature selector.

8. The bathing apparatus of claim 1 further including a water spraying means, the water spraying means comprising:

a spray nozzle connected to a hand-actuated valve, a water conducting hose, one end thereof in fluid communication with the valve at attached thereto, a water pump, the water pump in fluid communication with at least one of the water ports at a low pressure side thereof, and in fluid communication with an opposite end of the hose at a high pressure side thereof, the water pump further connected to a power source, whereby when the hand-actuated valve is actuated, the water pump pumps water from the tub through the hose and out of the spray nozzle.

9. The bathing apparatus of claim 1 wherein the at least one side wall further includes a drain aperture with a cooperating drain plug to allow selective draining of water in the tub.

10. The bathing apparatus of claim 1 wherein the outside surface of each of the at least one side wall of the tub further includes an outwardly and downwardly projecting lip, whereby water running down the outside surface of any of the at least one side walls of the tub is prevented from reaching the heat conduction means of the tub.

* * * * *